US011022263B2

(12) United States Patent
Tsukamoto et al.

(10) Patent No.: US 11,022,263 B2
(45) Date of Patent: Jun. 1, 2021

(54) HEADLIGHT FOR VEHICLE

(71) Applicant: KOITO MANUFACTURING CO., LTD., Tokyo (JP)

(72) Inventors: Hironori Tsukamoto, Shizuoka (JP); Kazutoshi Sakurai, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 16/452,822

(22) Filed: Jun. 26, 2019

(65) Prior Publication Data

US 2020/0003380 A1 Jan. 2, 2020

(30) Foreign Application Priority Data

Jun. 27, 2018 (JP) ..... JP2018-122030

(51) Int. Cl.

| | |
|---|---|
| ***F21S 41/143*** | (2018.01) |
| ***F21S 41/147*** | (2018.01) |
| ***F21S 41/255*** | (2018.01) |
| ***F21S 41/675*** | (2018.01) |
| ***F21S 45/70*** | (2018.01) |
| ***F21S 41/155*** | (2018.01) |

(52) U.S. Cl.

CPC ..... *F21S 41/143* (2018.01); *F21S 41/147* (2018.01); *F21S 41/155* (2018.01); *F21S 41/255* (2018.01); *F21S 41/675* (2018.01); *F21S 45/70* (2018.01)

(58) Field of Classification Search

CPC ..... F21S 41/143; F21S 41/675; F21S 41/147; F21S 41/155; F21S 41/255; F21S 45/70

See application file for complete search history.

(56) References Cited

U.S. PATENT DOCUMENTS

2006/0022211 A1* 2/2006 Yatsuda ..... H01L 25/0753 257/98
2009/0302338 A1* 12/2009 Nagai ..... H01L 33/54 257/98
2011/0222303 A1* 9/2011 Tokida ..... F21S 41/147 362/516

(Continued)

FOREIGN PATENT DOCUMENTS

| | | | | |
|---|---|---|---|---|
| CN | 1609503 A | * | 4/2005 | ..... F21S 41/143 |
| EP | 2 525 140 A2 | | 11/2012 | |
| JP | 2011-192451 A | | 9/2011 | |

OTHER PUBLICATIONS

Communication dated Feb. 26, 2021 from the National Intellectual Property Office of France in FR Application No. 1906904.

*Primary Examiner* — Mary Ellen Bowman
(74) *Attorney, Agent, or Firm* — Sughrue Mion, PLLC

(57) ABSTRACT

A headlight for a vehicle includes a light source. The light source includes: a substrate; a light emitting diode chip; and a phosphor. The phosphor through which light exiting from a light emitting surface penetrates. The phosphor includes an exiting surface through which the light from the light emitting surface penetrates and exits. A first direction of the exiting surface corresponds to a height direction of a light distribution pattern by the light exiting from the exiting surface, and a second direction of the exiting surface corresponds to a spread in a lateral direction of the light distribution pattern. A dimension in the first direction of the exiting surface is smaller than a dimension in the second direction of the exiting surface.

5 Claims, 7 Drawing Sheets

(56) References Cited

U.S. PATENT DOCUMENTS

| | | | | |
|---|---|---|---|---|
| 2011/0235355 | A1* | 9/2011 | Seko | H01L 33/50<br>362/510 |
| 2012/0211774 | A1* | 8/2012 | Harada | H01L 33/56<br>257/88 |
| 2012/0294023 | A1* | 11/2012 | Nakazato | F21S 41/125<br>362/510 |
| 2014/0022804 | A1* | 1/2014 | Konishi | F21S 41/16<br>362/487 |

* cited by examiner

HEADLIGHT FOR VEHICLE

INCORPORATION BY REFERENCE

The disclosure of Japanese Patent Application No. 2018-122030 filed on Jun. 27, 2018 including the specification, drawings and abstract is incorporated herein by reference in its entirety.

BACKGROUND

1. Technical Field

The present disclosure relates to a headlight for a vehicle.

2. Description of Related Art

In recent years, a light emitting diode (LED) has been mainly used as a light source of a headlight for a vehicle represented by an automobile headlight. By using an LED, effects of reducing heat generation and promoting power saving in a light emitting part can be expected.

The following Japanese Patent Application Publication No. 2011-192451 (JP 2011-192451 A) discloses a headlight for a vehicle including a light emitting module that includes: a light emitting unit using an LED; a frame defining a light emitting surface of the light emitting unit; and an optical member. The optical member projects an image utilizing a shape of the light emitting surface by light from the light emitting surface of the light emitting unit. By projecting the light from the light emitting surface through this optical member, at least a part of a light distribution pattern for a low beam is formed.

SUMMARY

In the headlight for the vehicle of JP 2011-192451 A, the light emitting surface of the light emitting unit using the LED is configured to have a square shape. This can be considered because the light emitting surface of the LED is generally formed in a square shape, and it is preferable to form a phosphor covering the LED in a square shape in a front view in order to make full use of the light exiting from the LED. In the headlight for the vehicle according to JP 2011-192451 A, the dimension of the light emitting surface in parallel to sides located on one side of respective sides mutually orthogonal and defining the square of the light emitting surface mainly contributes to a spread in the height direction of a light distribution pattern by the light from the light emitting surface. In addition, the dimension of the light emitting surface in parallel to sides located on the other side of the respective sides mutually orthogonal and defining the square of the light emitting surface mainly contributes to a spread in the lateral direction of the light distribution pattern by the light from the light emitting surface.

In the meantime, in the case in which the light exiting from the light source is reflected by a reflector or refracted by a projection lens to form a desired light distribution pattern, when the sides located on the one side of the square light emitting surface of the light source has a greater dimension, the light exiting from the light source can be applied in an unintended direction. More specifically, a reflector and a projection lens are designed such that the radiation direction of light exiting from the center of a light source is defined in a predetermined direction, and light exiting from an end of the light source might be radiated in an unintended direction by the reflector or the projection lens. Therefore, the light distribution pattern might blur. In addition, it is preferable to particularly reduce blurring in the height direction in the light distribution pattern of the headlight, from the viewpoint of suppressing unclearness in the cut line of the light distribution pattern, preventing pedestrians from being dazzled, etc.

Therefore, the present disclosure reduces blurring of the light distribution pattern.

A first aspect of the present disclosure is a headlight for a vehicle. The headlight includes a light source. The a light source includes: a substrate; a light emitting diode chip disposed on the substrate; and a phosphor disposed on a light emitting surface of the light emitting diode chip. The phosphor through which light exiting from the light emitting surface penetrates. The single light emitting diode chip is disposed on the single substrate. The phosphor includes an exiting surface through which the light from the light emitting surface penetrates and exits. A first direction of the exiting surface corresponds to a height direction of a light distribution pattern by the light exiting from the exiting surface, and a second direction of the exiting surface corresponds to a spread in a lateral direction of the light distribution pattern. The second direction of the exiting surface is perpendicular to the first direction of the exiting surface. A dimension in the first direction of the exiting surface is smaller than a dimension in the second direction of the exiting surface.

With the above configuration, the light from the light emitting diode chip penetrates through the phosphor and exits from the exiting surface of the phosphor. Therefore, it can be said that the exiting surface of the phosphor is the light emitting surface of the light source. The dimension in the first direction of the light emitting surface of the light source corresponding to the spread in the height direction of the light distribution pattern by the light exiting from the light source is smaller than the dimension in the second direction of the light emitting surface of the light source corresponding to the spread in the lateral direction of the light distribution pattern. Therefore, in the light distribution pattern by the light exiting from the light source, it is possible to secure a sufficient spread of the light in the lateral direction, while reducing an unintended spread of the light in the height direction. By reducing the unintended spread of the light in the height direction, blurring of the light distribution pattern can be reduced.

In the above headlight for the vehicle, a plurality of the light sources may be arranged along the second direction.

With the above configuration, by arranging the plurality of light sources along the second direction, it is easy to form the light distribution pattern having a predetermined spread in the lateral direction, while reducing an unintended spread of the light in the height direction. Further, since the dimension in the second direction of the light emitting surface of each light source is larger than the dimension in the first direction thereof, in the case of arranging a plurality of light sources along the second direction in a predetermined range, a ratio of the distance between the respective light emitting surfaces of each two adjacent light sources relative to the area of the light emitting surface of each light source is smaller than that in the case in which the light emitting surface of each light source is square. Therefore, the lights exiting from each two adjacent light sources are likely to overlap each other, and thus generation of unevenness in the light distribution pattern can be reduced.

In the above headlight for the vehicle, the respective light sources may be configured to individually perform lighting or extinguishing.

With the above configuration, as the respective light sources are configured to individually perform lighting or extinguishing, it is possible to configure the headlight to be suitable for an adaptive driving beam (ADB) or the like.

In the above headlight for the vehicle, the light emitting surface of the light emitting diode chip may have a square shape.

With the above configuration, by configuring the light emitting surface of the light emitting diode chip to be in a square shape, it is possible to adopt a light emitting diode chip used for a general headlight.

In the above headlight for the vehicle, the dimension in the second direction of the exiting surface may be larger than a dimension in the second direction of the light emitting surface, and the dimension in the first direction of the exiting surface may be smaller than a dimension in the first direction of the light emitting surface.

With the above configuration, the dimension in the second direction of the exiting surface of the phosphor is larger than the dimension in the second direction of the light emitting surface of the light emitting diode chip; and the dimension in the first direction of the exiting surface of the phosphor is smaller than the dimension in the first direction of the light emitting surface of the light emitting diode chip. Therefore, in the light distribution pattern generated by the light exiting from the light source, it becomes easier to reduce the spread of the light in the height direction, while securing a sufficient spread of the light in the lateral direction.

In the above headlight for the vehicle, in a front view of the light source, a center of the light emitting surface of the light emitting diode chip may overlap a center of the exiting surface of the phosphor.

With the above configuration, when the light emitting surface of the light source is viewed along the optical axis of the light source, the light emitting diode chip and the phosphor are arranged such that the center of the light emitting surface of the light emitting diode chip and the center of the exiting surface of the phosphor overlap each other, to thereby facilitate entry and penetration of the light emitted by the light emitting diode chip through the phosphor.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Hereinafter, a mode for carrying out a headlight for a vehicle according to the present disclosure will be exemplified together with the attached drawings. Embodiments exemplified below are for the purpose of facilitating understanding of the present disclosure, but are not for the purpose of limiting the present disclosure. The present disclosure can be changed or modified from the following embodiments without departing from the gist of the disclosure.

Figure 1:
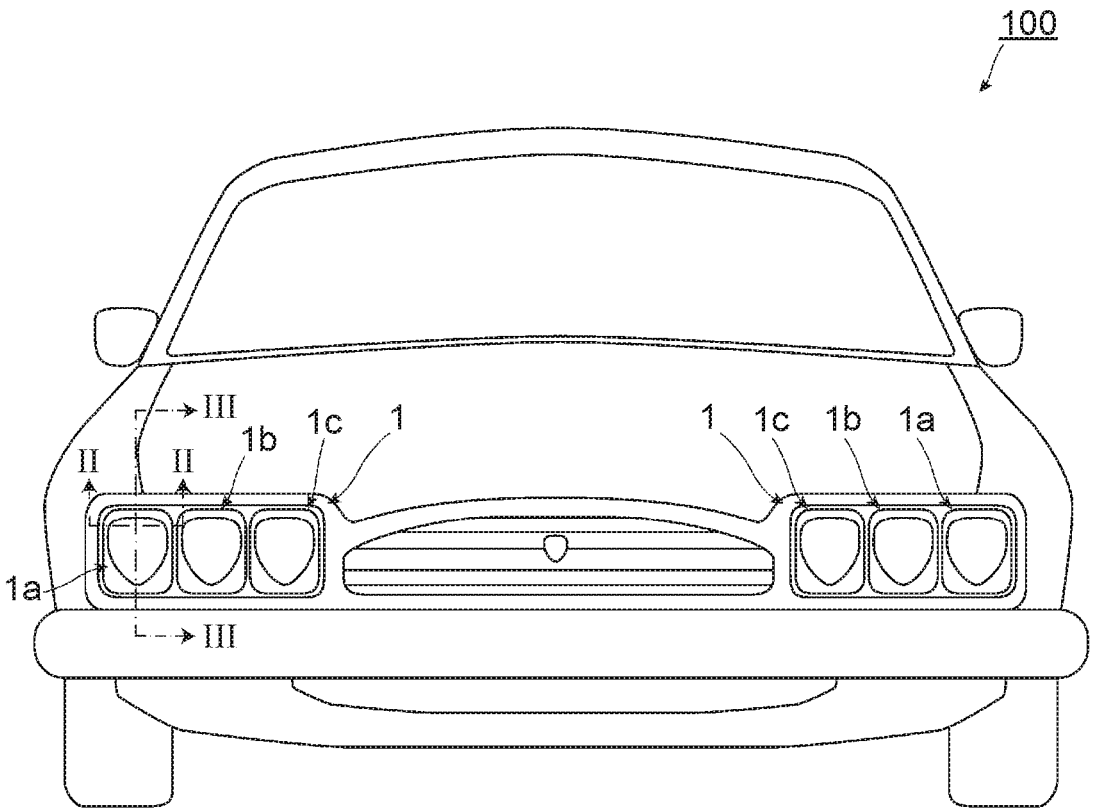
FIG. 1 is a front view schematically showing a vehicle provided with a headlight according to a first embodiment of the present disclosure.

FIG. 1 is a front view showing an outline of a vehicle provided with headlights according to a first embodiment of the present disclosure. As shown in FIG. 1, a vehicle 100 is provided with a pair of headlights 1 on front left and right sides, respectively. A pair of headlights 1 provided in the vehicle 100 are symmetrical in the lateral direction. Each headlight 1 of the present embodiment includes a plurality of lamps 1*a*, 1*b*, 1*c* arranged side by side with each other, the lamp 1*a* is disposed on the outermost side of the vehicle 100, the lamp 1*c* is disposed on the most center side of the vehicle 100, and the lamp 1*b* is disposed between the lamp 1*a* and the lamp 1*c*.

Figure 2:
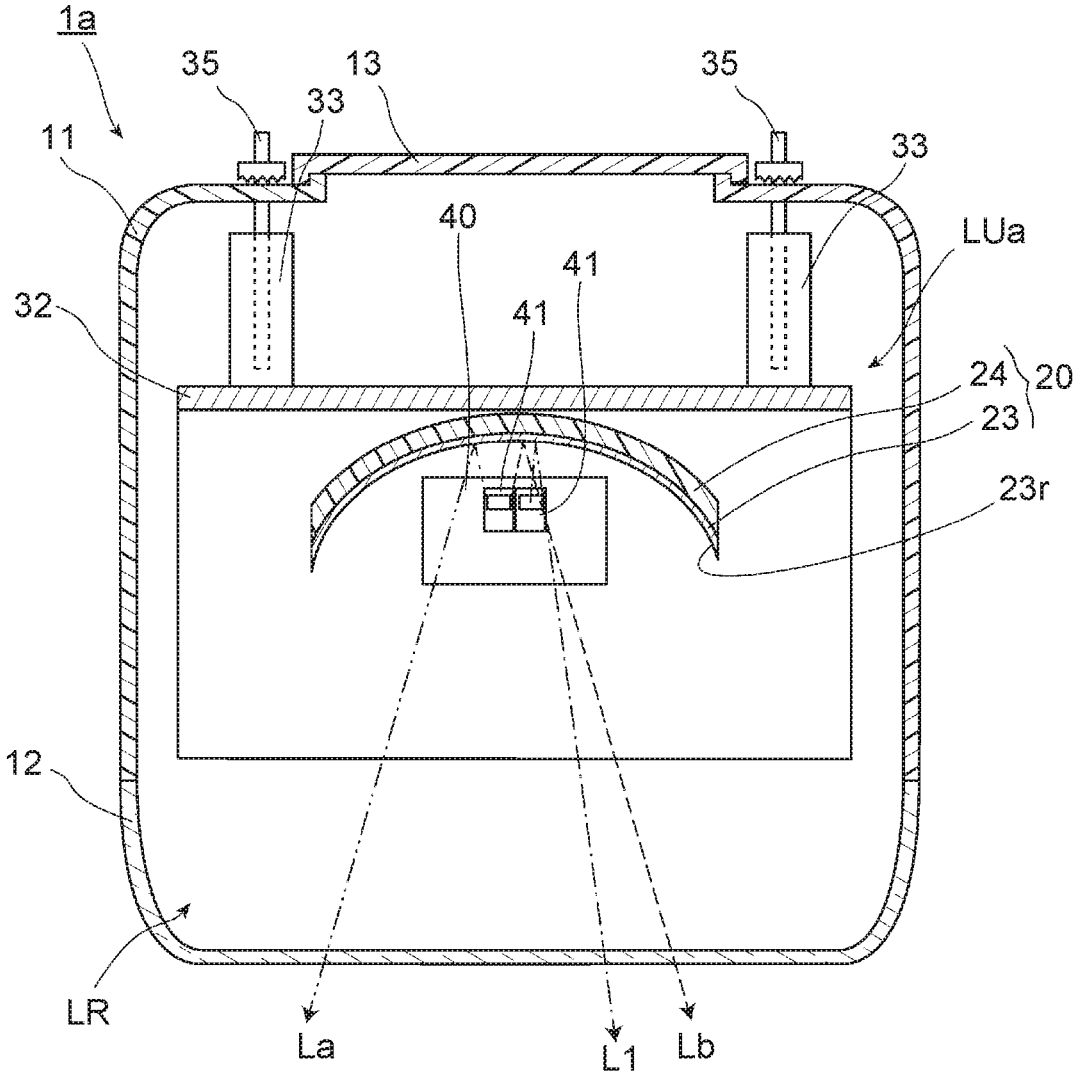
FIG. 2 is a horizontal sectional view of a single lamp taken along line II-II in FIG. 1.
Figure 3:
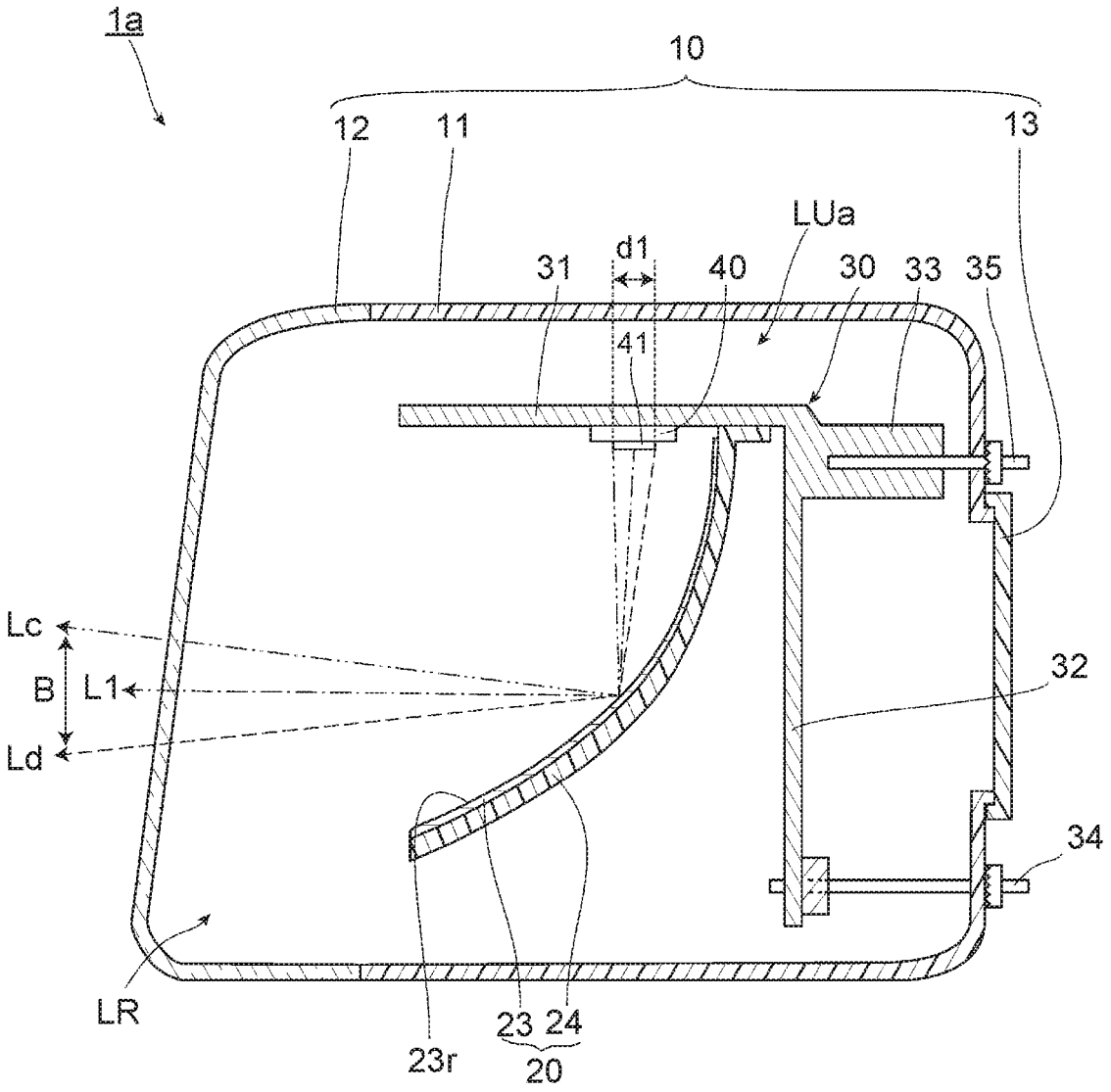
FIG. 3 is a vertical sectional view of the single lamp taken along line III-III in FIG. 1.

FIG. 2 is a view schematically showing a horizontal cross section parallel to the II-II line in FIG. 1, and FIG. 3 is a view schematically showing a vertical cross section parallel to the III-III line in FIG. 1. That is, FIG. 2 is a horizontally sectional view of an upper part of the lamp 1*a*, and FIG. 3 is a perpendicularly sectional view of the lamp 1*a* substantially at the center in the lateral direction. As shown in FIGS. 2 and 3, the lamp 1*a*, which is a part of the headlight 1, includes a housing 10 and a lamp unit LUa housed in the housing 10.

The housing 10 mainly includes a lamp housing 11, a front cover 12, and a back cover 13. A front part of the lamp housing 11 is open, and the front cover 12 is fixed to the lamp housing 11 so as to close this front opening. Further, an opening smaller than the front opening is formed at a rear part of the lamp housing 11, and the back cover 13 is fixed to the lamp housing 11 so as to close this rear opening.

A space formed by the lamp housing 11, the front cover 12 closing the front opening of the lamp housing 11, and the back cover 13 closing the rear opening of the lamp housing 11 is a lamp chamber LR, and a lamp unit LUa is accommodated in the lamp chamber LR.

The lamp unit LUa mainly includes a reflector 20, a support member 30, a light source support substrate 40, and light sources 41.

The support member 30 is a metal member, and includes a top plate 31, a back plate 32, and a locking portion 33. The top plate 31 is a plate-like metal member extending in a generally horizontal direction, and the back plate 32 is a plate-like metal member extending in a generally perpendicular direction. A rear end of the top plate 31 and an upper end of the back plate 32 are connected to each other. Further, a locking portion 33 is connected to the vicinity of the upper end of the back plate 32. The locking portion 33 extends rearward from the back plate 32, and the locking portion 33 is formed with a screw hole opening rearward. A screw 35 is screwed into this screw hole from the outer side of the lamp housing 11, and the locking portion 33 is fixed to the lamp housing 11. Further, a screw hole is formed also in a lower portion of the back plate 32, and a screw 34 is screwed into this screw hole from the outer side of the lamp housing 11 so as to fix the back plate 32 to the lamp housing 11. Thus, the back plate 32 is fixed in the inside of the lamp chamber LR in a substantially vertical state, and the top plate 31 connected to the back plate 32 is also fixed in the inside of the lamp chamber LR. The angle of the back plate 32 can be finely adjusted through adjustment of these screws 34, 35, and thus the angle of the top plate 31 can also be finely adjusted.

The reflector 20 is fixed to a lower surface of the top plate 31. The reflector 20 has a reflector body 24 and a plated portion 23. The reflector body 24 is made of resin. The plated portion 23 is a thin film formed of a metal such as aluminum or a metal oxide on the front surface of the reflector body 24. A surface of this plated portion 23 is configured as a light reflecting surface 23*r*. The reflecting surface 23*r* has, for example, a concave shape formed of a free-form surface based on a parabola having its opening direction facing the front side. More specifically, the shape of the reflecting surface 23*r* in the vertical cross section is configured to be a shape lower than a vertex of the parabola with a central axis of the parabola set substantially horizontal, and the shape of the reflecting surface 23*r* in the horizontal cross section is configured to be a shape generally including the vertex of the parabola. However, the parabola of the reflecting surface 23*r* in the vertical cross section and the parabola of the reflecting surface 23*r* in the horizontal cross section may be different from each other. The shape of the reflecting surface 23*r* in the horizontal cross section may not be based on the parabolic shape, or may be a shape partially based on an ellipse or another concave shape, for example.

Further, the light source support substrate 40 is disposed on the lower surface of the top plate 31, and the light sources 41 are mounted on the light source support substrate 40. The lamp unit LUa of the present embodiment includes two light sources 41 arranged side by side in the lateral direction. However, the number of light sources 41 is not particularly limited, and may be one or three or more. The light source 41 of the present embodiment emits light that serves as part of a low beam or a high beam.

Figure 4:
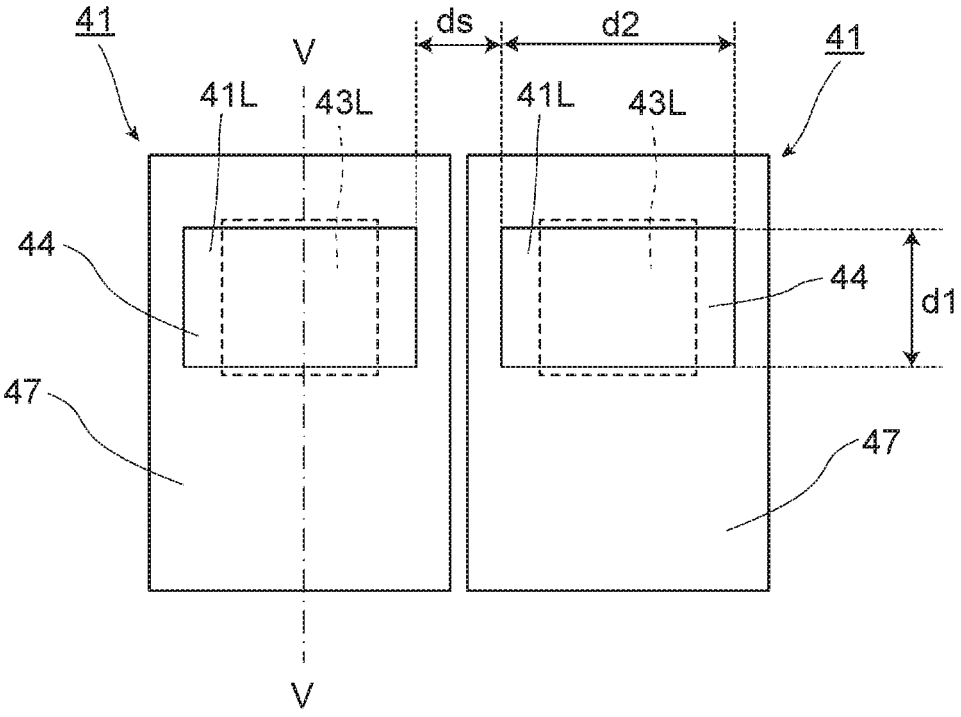
FIG. 4 is an enlarged plan view of light sources shown in FIG. 2.
Figure 5:
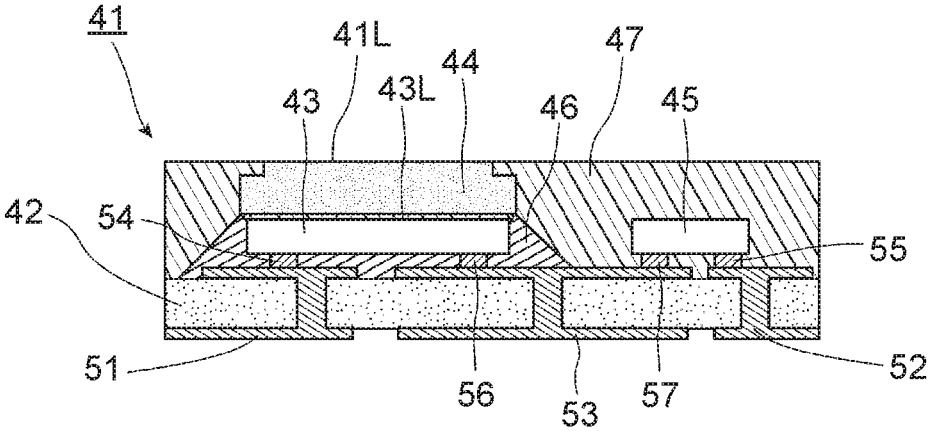
FIG. 5 is a sectional view of each light source in the perpendicular direction taken along line V-V shown in FIG. 4.

FIG. 4 is a plan view showing the light sources 41 shown in FIG. 2 in an enlarged manner, and FIG. 5 is a sectional view of each light source 41 in the perpendicular direction taken along line V-V shown in FIG. 4. As shown in FIGS. 4 and 5, each light source 41 of the present embodiment includes a substrate 42, an LED chip 43 disposed on the substrate 42, a phosphor 44 disposed on a light emitting surface 43L of the LED chip 43, a protection element 45, a reflective material 46, a sealing resin 47, terminals 51, 52, and a ground terminal 53.

The substrate 42 is a substrate in which the terminals 51, 52 and the ground terminal 53, which are electrically connected to the LED chip 43 and a protection element 45 protecting the LED chip 43 from excessive current, are integrated. A single LED chip 43 is disposed on a single substrate 42.

The LED chip 43 is electrically connected to the terminal 51 via a gold bump 54, and is electrically connected to the ground terminal 53 via a gold bump 56. The protection element 45 is electrically connected to the terminal 52 via a gold bump 55, and is electrically connected to the ground terminal 53 via a gold bump 57. The terminal 51 and the terminal 52 are electrically connected in parallel by a circuit (not shown) or the like. The LED chip 43 is fed with power via the terminal 51 to emit light. Further, the LED chip 43 is surrounded by the reflective material 46, and light emitted by the LED chip 43 can efficiently enter the phosphor 44. In the light source 41, the members on the substrate 42 are covered with the sealing resin 47 except for an exiting surface 41L of the phosphor 44 described later. The sealing resin 47 is made of a white silicone resin, for example.

The LED chip 43 has a single light emitting surface 43L, and the light emitting surface 43L is covered with a single phosphor 44. At least a part of the light exiting from the light emitting surface 43L enters the phosphor 44 and then exits from the exiting surface 41L of the phosphor 44. Therefore, the exiting surface 41L of the phosphor 44 serves as a light emitting surface of the light source 41. The light exiting from the LED chip 43 passes through the phosphor 44 as described above, whereby the light source 41 emits light in a desired color.

The phosphor 44 covers the light emitting surface 43L of the LED chip 43 as described above, and a surface of the phosphor 44 on the opposite side to the LED chip 43 is configured as the exiting surface 41L from which light from the light emitting surface 43L exits. As shown in FIG. 4, the exiting surface 41L of the phosphor 44, that is, the light emitting surface of the light source 41 has a rectangular shape. Note that in FIG. 4, the light emitting surfaces 43L of the LED chips 43 hidden by the phosphors 44 are indicated by broken lines, respectively. In a front view of the light source 41 shown in FIG. 4, the center of the light emitting surface 43L of the LED chip 43 and the center of the exiting surface 41L of the phosphor 44 overlap each other. Further, as shown in FIG. 4, the dimension in the lateral direction of the exiting surface 41L of the phosphor 44 is larger than the dimension in the lateral direction of the light emitting surface 43L of the LED chip 43, and the dimension in the height direction of the exiting surface 41L of the phosphor 44 is smaller than the dimension in the height direction of the light emitting surface 43L of the LED chip 43.

The exiting surface 41L of the phosphor 44 has a rectangular shape having a dimension d1 in the first direction smaller than a dimension d2 in the second direction. The dimension d1 in the first direction is set to be 0.95 mm, for example, and the dimension d2 in the second direction is set to be 1.15 mm, for example. Further, a distance ds between the respective exiting surfaces 41L of the phosphors 44 adjacent to each other is set to be 0.6 mm, for example.

The dimension d1 in the first direction of the light emitting surface of the light source 41 having this configuration corresponds to a spread in the height direction of the light distribution pattern by the light from the light source 41. That is, when the dimension d1 in the first direction of the light emitting surface of the light source 41 is set larger without changing the dimension d2 in the second direction thereof, the light distribution pattern by the light from the light source 41 spreads out more greatly in the height direction than in the lateral direction. As shown in FIG. 3, the light L1 exiting from the center of the light emitting surface of the light source 41 is reflected by the reflecting surface 23*r* of the reflector 20 and is applied to a desired position. Light Lc exiting from a front end of the light emitting surface, which is one end in the first direction of the light emitting surface of the light source 41, is reflected by the reflecting surface 23*r* of the reflector 20 and is then radiated above the position to which the light L1 is applied. Light Ld exiting from the rear end of the light emitting surface, which is the other end in the first direction of the light emitting surface of the light source 41, is reflected by the reflecting surface 23*r* of the reflector 20 and is then radiated below the position to which the light L1 is applied. Thus, as the dimension d1 in the first direction of the light emitting surface of the light source 41 increases, a difference B between the position radiated with the light Lc and the position radiated with the light Ld increases, and the light distribution pattern is more likely to blur.

The dimension d2 in the second direction of the light emitting surface of the light source 41 corresponds to a spread in the lateral direction of the light distribution pattern by the light from the light source 41. That is, when the dimension d2 in the second direction is set larger without changing the dimension d1 in the first direction of the light emitting surface of the light source 41, the light distribution pattern by the light from the light source 41 spreads more in the lateral direction than in the height direction. As shown in FIG. 2, light La exiting from a left end, which is one end in the second direction of the light emitting surface of the light source 41, is reflected by the reflecting surface 23*r* of the reflector 20 and is then applied more leftward than light exiting from the center of the light emitting surface of the light source 41. Light Lb exiting from a right end, which is the other end in the second direction of the light emitting surface of the light source 41, is reflected by the reflecting surface 23*r* of the reflector 20 and is then applied more rightward than the light exiting from the center of the light emitting surface of the light source 41.

As described above, in the light source 41 of the present embodiment, the first direction of the light emitting surface of the light source 41 is the front-rear direction of the vehicle 100, and the second direction of the light emitting surface of the light source 41 is the lateral direction of the vehicle 100.

The light sources 41 as described above are respectively mounted on the light source support substrate 40 and connected to a light emission control circuit (not shown) provided on the light source support substrate 40. Further, each light source 41 can emit light by power fed from a light emission control circuit provided on the light source support substrate 40. Hence, lightning and extinguishing of each light source 41 is controlled by the light emission control circuit.

Next, operation and effects of the headlight 1 for the vehicle of the present embodiment will be described.

By adjusting the position of the light sources 41, the shape of the reflecting surface 23*r*, and others, the lamp 1*a* of the present embodiment is configured as a low beam lamp or a high beam lamp.

Figure 6A:
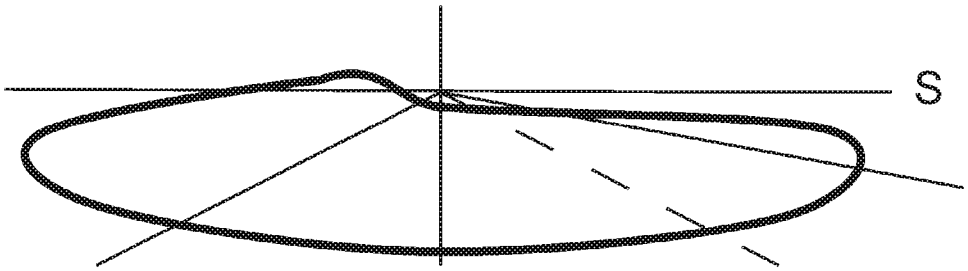
FIG. 6A shows a light distribution pattern of a low beam.

When the lamp 1*a* is configured as a low beam lamp, the light L1 from each light source 41 forms a part of the light distribution pattern in the low beam shown in FIG. 6A. As shown in FIG. 3, most of the light L1 exiting from the light sources 41 is reflected by the reflecting surface 23*r*, and after being reflected by the reflecting surface 23*r*, the light L1 is radiated below a cut line of the low beam. In this case, at least a part of the light distribution pattern in the low beam is formed by the lamps 1*a* provided on the left and right of the vehicle 100.

Figure 6B:
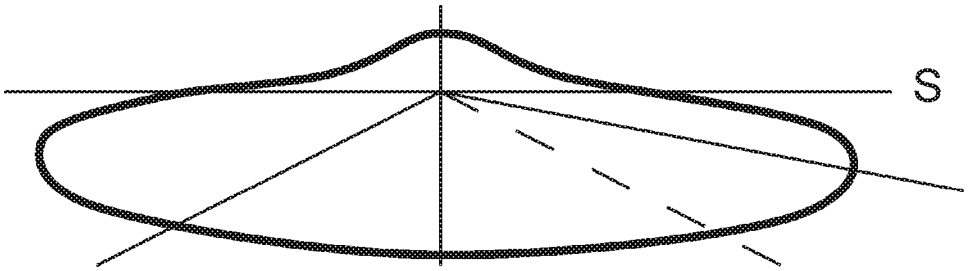
FIG. 6B shows a light distribution pattern of a high beam.

On the other hand, when the lamp 1*a* is configured as a high beam lamp, the light L1 from the light source 41 forms a part of the light distribution pattern in the high beam shown in FIG. 6B. As shown in FIG. 3, most of the light L1 exiting from the light source 41 is reflected by the reflecting surface 23*r*, and a part of the light distribution pattern in the high beam is formed. In this case, at least a part of the light distribution pattern in the high beam is formed by the lamps 1*a* provided on the left and right of the vehicle 100.

As described above, the headlight 1 for the vehicle of the present embodiment includes the light sources 41 each including: the substrate 42; the LED chip 43 disposed on the substrate 42; and the phosphor 44 which is disposed on the light emitting surface 43L of the LED chip 43, and through which the light exiting from the light emitting surface 43L penetrates. Each single LED chip 43 is disposed on each single substrate 42. Further, the phosphor 44 has the exiting surface 41L through which the light from the light emitting surface 43L of the LED chip 43 penetrates and exits; the first direction of the exiting surface 41L corresponds to the height direction of the light distribution pattern by the light exiting from the exiting surface 41L; the second direction perpendicular to the first direction of the exiting surface 41L corresponds to a spread of the light distribution pattern in the lateral direction rather than in the height direction; and the dimension d1 in the first direction of the exiting surface 41L is smaller than the dimension d2 in the second direction of the exiting surface 41L.

In the headlight 1 for the vehicle of the present embodiment, the light from the LED chip 43 penetrates through the phosphor 44 and exits from the exiting surface 41L of the phosphor 44. Therefore, it can be said that the exiting surface 41L of the phosphor 44 is the light emitting surface of the light source 41. The dimension d1 in the first direction of the light emitting surface of the light source 41 corresponding to the spread in the height direction of the light distribution pattern by the light from the light source 41 is smaller than the dimension d2 in the second direction of the light emitting surface of the light source 41 corresponding to the spread in the lateral direction of the light distribution pattern. Therefore, in the light distribution pattern by the light exiting from the light source 41, it is possible to secure a sufficient spread of the light in the lateral direction, while suppressing an unintended spread of the light in the height direction. By suppressing an unintended spread of the light in the height direction, blurring of the light distribution pattern can be reduced.

In addition, by arranging a single LED chip 43 on each substrate 42, in the case of using a plurality of LED chips 43, heat transfer between the LED chips 43 adjacent to each other can be suppressed. Furthermore, by arranging a single LED chip 43 on each substrate 42, when using a plurality of LED chips 43, flexibility of the arrangement positions of each LED chip 43 is increased, and thus a desired light distribution pattern can be easily formed.

Further, in the headlight 1 for the vehicle of the present embodiment, the lamp 1*a* includes the plurality of light sources 41, and the plurality of light sources 41 are arranged side by side along the second direction. Arrangement of the plurality of light sources 41 along the second direction facilitates formation of the light distribution pattern having a predetermined spread in the lateral direction, while suppressing an unintended spread of the light in the height direction. Further, since the dimension d2 in the second direction of the light emitting surface of each light source 41 is larger than the dimension d1 in the first direction thereof, in the case in which the plurality of light sources 41 are arranged side by side in the second direction in a predetermined range, a ratio of the distance ds between the light emitting surfaces of each two adjacent light sources 41 relative to the area of the light emitting surface of each light source 41 is smaller than that in the case where the light emitting surface of each light source 41 is square. Therefore, the lights respectively exiting from each two adjacent light sources 41 easily overlap each other, and thus generation of unevenness in the light distribution pattern can be reduced.

Moreover, in the headlight 1 for the vehicle of the present embodiment, the light emitting surface 43L of the LED chip 43 is a square. By configuring the light emitting surface 43L of the LED chip 43 in a square shape, it is possible to adopt an LED chip used for a general headlight for the vehicle.

In the front view of the light source 41, the center of the light emitting surface 43L of the LED chip 43 and the center of the exiting surface 41L of the phosphor 44 overlap each other. When the light emitting surface of the light source 41 is viewed along the optical axis of the light source 41, the LED chip 43 and the phosphor 44 are arranged such that the center of the light emitting surface 43L of the LED chip 43 and the center of the exiting surface 41L of the phosphor 44 overlap with each other, to thereby facilitate entry and penetration of the light emitted by the LED chip 43 through the phosphor 44. Further, the dimension d2 in the second direction of the exiting surface 41L of the phosphor 44 is larger than the dimension in the second direction of the light emitting surface 43L of the LED chip 43; and the dimension d1 in the first direction of the exiting surface 41L is smaller than the dimension in the first direction of the light emitting surface 43L. Therefore, in the light distribution pattern by the light exiting from the light source 41, it becomes easier to reduce the spread of the light in the height direction, while securing a sufficient spread of the light in the lateral direction.

Next, a second embodiment of the present disclosure will be described in detail with reference to the drawings. Note that the same or equivalent components as those of the first embodiment will be denoted by the same reference numerals and overlapping description thereof will be omitted unless otherwise specifically mentioned.

Figure 7:
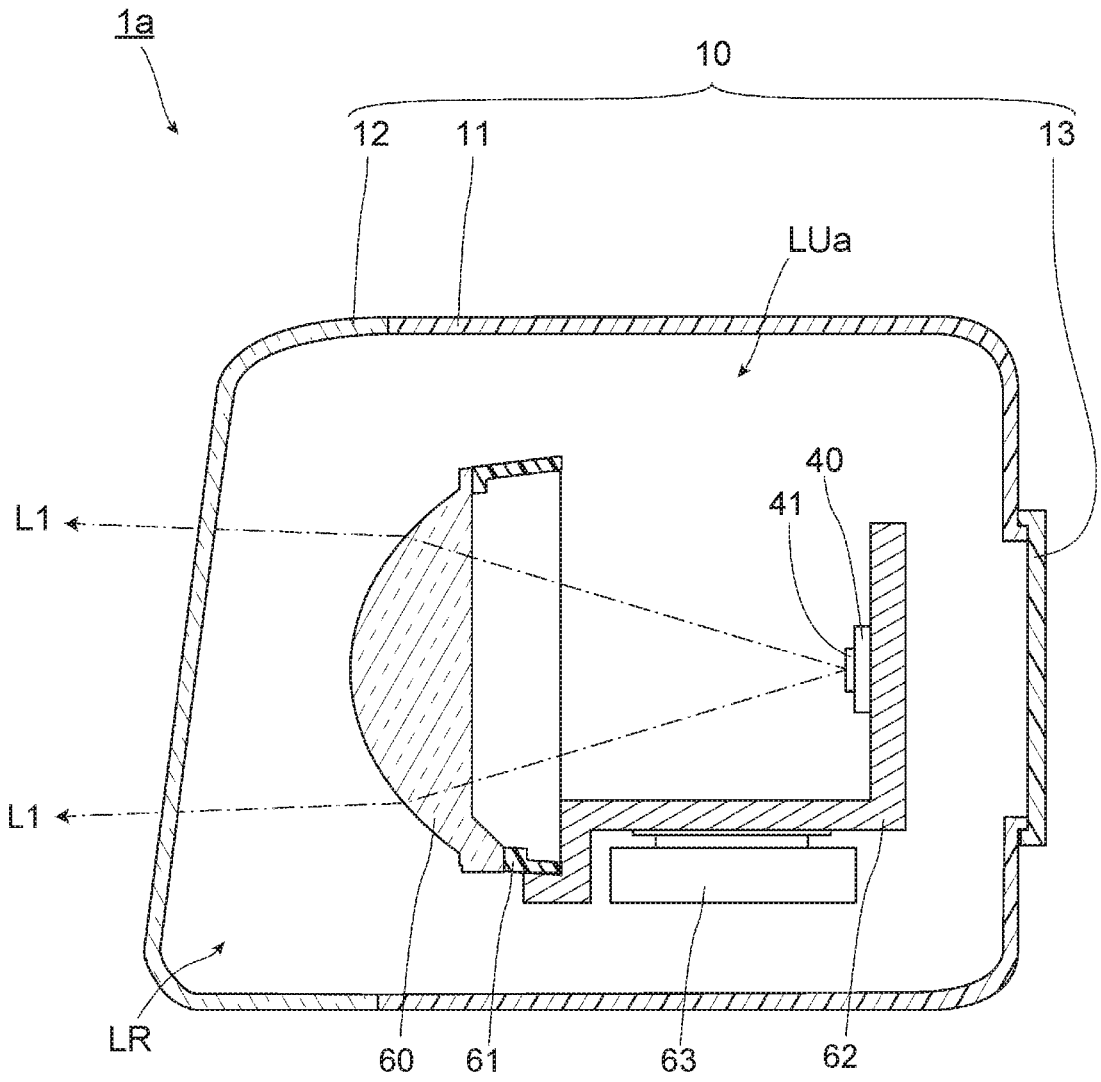
FIG. 7 is a view showing a lamp according to a second embodiment of the present disclosure in the same manner as FIG. 3.

FIG. 7 is a view schematically showing a vertical cross section of each lamp according to the second embodiment of the present disclosure. That is, FIG. 7 is a view showing the cross section of the lamp 1*a* according to the present embodiment from the same viewpoint as that in FIG. 3.

The lamp unit LUa included in the lamp 1*a* of the present embodiment is mainly different from the lamp unit LUa of the first embodiment in that the lamp unit LUa is a projector-type lamp unit. In addition, each of the lamp 1*b* and the lamp 1*c* of the present embodiment may have the same configuration as that of the lamp 1*a*, or may have a different configuration from that of the lamp 1*a*.

The lamp unit LUa of the present embodiment includes a projection lens 60, a lens holder 61, a light source 41, a base member 62, and a turning mechanism 63.

The projection lens 60 is a plano-convex aspheric lens having a convex front surface and a flat rear surface. The projection lens 60 projects a light source image, as a reverse image, formed on a rear focal plane, which is a focal plane including a rear focal point, frontward of the lamp 1*a* in a virtually perpendicular direction. Further, the projection lens 60 has a flange on its outer periphery, and this flange is fixed to the lens holder 61.

Figure 8:
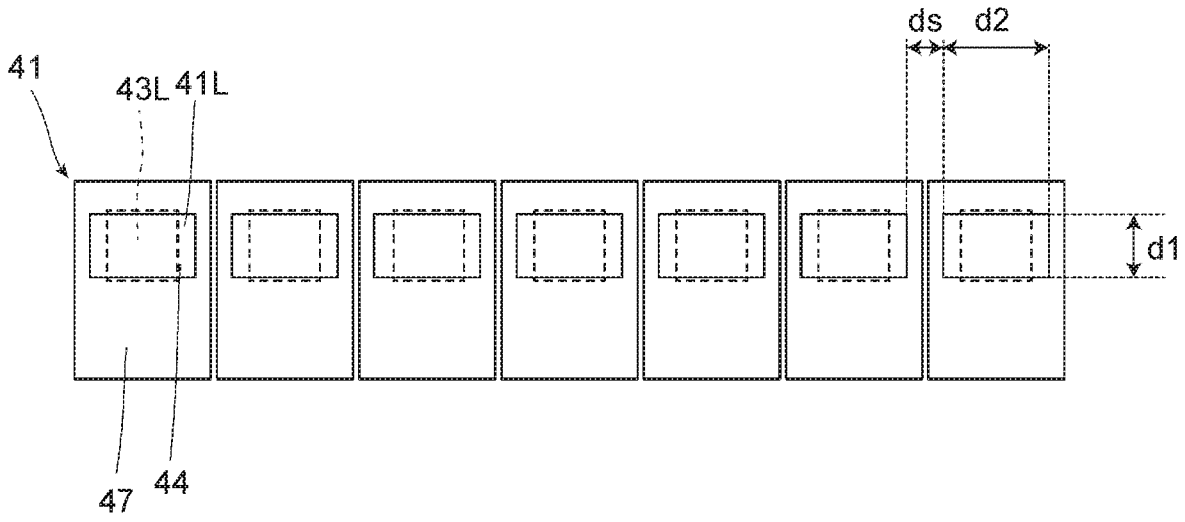
FIG. 8 is a view of the light source shown in FIG. 7 as viewed from the front side.

Although only one reference numeral for the light source 41 is illustrated in FIG. 8, a plurality of light sources 41 are provided. FIG. 8 is a view showing the plurality of light sources 41 provided in the lamp unit LUa of the present embodiment, as viewed from the front, that is, from the projection lens 60 side. As shown in FIG. 8, the lamp unit LUa of the present embodiment includes seven light sources 41. However, the number of light sources 41 is not particularly limited.

The plurality of light sources 41 are arranged in parallel in the lateral direction behind the rear focal point of the projection lens 60. In the present embodiment, the plurality of light sources 41 are arranged at equal intervals in the lateral direction, having a center at a position where the light sources 41 overlap the optical axis of the projection lens 60. The light exiting from these light sources 41 and directed to the projection lens 60 passes through the rear focal plane of the projection lens 60 with a spread at a certain degree. At this time, the lights exiting from the adjacent light sources 41 partially overlap each other.

Further, the plurality of light sources 41 of the present embodiment are respectively configured to individually perform adjustment of brightness and control of lighting or extinguishing. For example, the plurality of light sources 41 are respectively connected to a not-shown electronic control unit (ECU), and thus the light sources 41 are respectively controlled with signals from the electronic control unit so as to individually perform adjustment of brightness and control of lighting or extinguishing in accordance with the traveling conditions of the vehicle.

The base member 62 is a member for supporting the lens holder 61 and the light source support substrate 40. Further, the base member 62 is supported by the turning mechanism 63.

The turning mechanism 63 is a member having a mechanism for turning the base member 62. Since the light source 41 and the projection lens 60 are turned by turning of the base member 62, the radiation direction of the light from the lamp unit LUa is changed. Further, the turning mechanism 63 is connected to an ECU (not shown), and the turning mechanism 63 performs the above turning in response to signals from the ECU in accordance with the traveling conditions of the vehicle, and the radiation direction of the light from the lamp unit LUa is thus adjusted.

Next, operation and effects of the headlight 1 for the vehicle of the present embodiment will be described.

By adjusting the positions of the light sources 41, the shape of the projection lens 60, and others, the lamp 1*a* according to the present embodiment is configured as a low beam lamp or as a high beam lamp. That is, as shown in FIG. 8, the light L1 exiting from each light source 41 is adjusted in its irradiation direction as the light L1 penetrates through the projection lens 60, to thereby form a part of the light distribution pattern of the low beam shown in FIG. 6A or a part of the light distribution pattern of the high beam shown in FIG. 6B.

In the above manner, even when the light from the light source 41 penetrates through the projection lens 60 to be applied, as with the case in which a reflector is used as in the first embodiment, when the dimension d1 in the first direction of the light source 41 is increased, the light distribution pattern is more likely to blur. Also in the lamp unit LUa of the present embodiment, the dimension d1 in the first direction of the light emitting surface of the light source 41 corresponding to the spread in the height direction of the light distribution pattern is smaller than the dimension d2 in the second direction of the light emitting surface of the light source 41 corresponding to the spread in the lateral direction of the light distribution pattern. Therefore, in the light distribution pattern by the light L1 exiting from the light source 41, a sufficient spread of the light in the lateral direction can be ensured, while reducing an unintended spread of the light in the height direction. By reducing the unintended spread of the light in the height direction, blurring of the light distribution pattern can be reduced.

Further, in the present embodiment, as described above, the light sources 41 are respectively controlled with signals from the not-shown ECU so as to individually perform adjustment of brightness and control of lighting or extinguishing. Therefore, the headlight 1 for the vehicle provided with the lamp 1*a* of the present embodiment is suitable for an adaptive driving beam (ADB) or the like.

Although the present disclosure has been described by exemplifying the embodiments, the present disclosure is not limited to these embodiments.

For example, the number and arrangement of the light sources 41 are not particularly limited. The number of the light sources 41 may be one or more. The number and arrangement of the light sources 41 can be appropriately selected depending on the function required for the lamp 1*a*. Also, a single lamp 1*a* may be configured to serve as both a high beam lamp and a low beam lamp.

Further, the shape of the light emitting surface 43L of the LED chip 43 in a front view is not limited to a square shape. For example, the shape of the light emitting surface 43L of the LED chip 43 in a front view may be the same shape as that of the exiting surface 41L or a similar shape to the exiting surface 41L.

In addition, the number of lamps is not particularly limited. When multiple lamps are provided, a position of each lamp is not particularly limited. Therefore, for example, in the above embodiment, the lamp 1*a* may be disposed on the most central side of the vehicle 100.

Moreover, in the first embodiment, the manner of disposing the reflector 20 below the light source 41 has been described; however, the reflector 20 may be provided above the light source 41.

Furthermore, the present disclosure is not limited to the above embodiments, and is applicable to any headlight for the vehicle that emits light through a reflector or a lens.

As described above, according to the present disclosure, it is possible to provide the headlight for the vehicle capable of reducing blurring of the light distribution pattern. The headlight for the vehicle can be utilized in the field of headlights, such as motor vehicles.

What is claimed is:

1. A headlight for a vehicle, the headlight comprising a light source support substrate; and a plurality of light sources, each light source of the plurality of light sources including: a single substrate; a single light emitting diode chip disposed on the single substrate; and a single phosphor disposed on a light emitting surface of the single light emitting diode chip, the single phosphor through which light exiting from the light emitting surface penetrates, the single light emitting diode chip being disposed on the single substrate, the single phosphor including an exiting surface through which a light from the single light emitting surface penetrates and exits, a first direction of the exiting surface corresponding to a height direction of a light distribution pattern by the light exiting from the exiting surface, a second direction of the exiting surface corresponding to a spread in a lateral direction of the light distribution pattern, the second direction of the exiting surface being perpendicular to the first direction of the exiting surface, a dimension in the first direction of the exiting surface being smaller than a dimension in the second direction of the exiting surface; and the plurality of the light sources are arranged along the second direction on the light source support substrate.

2. The headlight for the vehicle according to claim 1, wherein the each respective light source of the plurality of light sources is configured to individually perform lighting or extinguishing.

3. The headlight for the vehicle according to claim 1, wherein the light emitting surface of the single light emitting diode chip has a square shape.

4. The headlight for the vehicle according to claim 1, wherein the dimension in the second direction of the exiting surface is larger than a dimension in the second direction of the light emitting surface, and the dimension in the first direction of the exiting surface is smaller than a dimension in the first direction of the light emitting surface.

5. The headlight for the vehicle according to claim 1, wherein in a front view of the light source, a center of the light emitting surface of the light emitting diode chip overlaps a center of the exiting surface of the single phosphor.

* * * * *